US010938144B2

(12) United States Patent
Bath et al.

(10) Patent No.: US 10,938,144 B2
(45) Date of Patent: Mar. 2, 2021

(54) ELECTRICAL CONNECTION SYSTEM SUITABLE FOR PROVIDING CATHODIC PROTECTION UNDERWATER

(71) Applicant: Deepwater Corrosion Services, Inc., Houston, TX (US)

(72) Inventors: William R. Bath, Houston, TX (US); Chris Thayer, Houston, TX (US); Matthew Taylor, Houston, TX (US)

(73) Assignee: DEEPWATER CORROSION SERVICES, INC., Houston, TX (US)

( * ) Notice: Subject to any disclaimer, the term of this patent is extended or adjusted under 35 U.S.C. 154(b) by 51 days.

(21) Appl. No.: 16/523,424

(22) Filed: Jul. 26, 2019

(65) Prior Publication Data

US 2020/0044382 A1 Feb. 6, 2020

Related U.S. Application Data

(60) Provisional application No. 62/713,007, filed on Aug. 1, 2018.

(51) Int. Cl.

| | |
|---|---|
| ***H01R 4/56*** | (2006.01) |
| ***H01R 13/523*** | (2006.01) |
| ***H01R 43/26*** | (2006.01) |
| ***H01R 4/26*** | (2006.01) |
| ***H01R 13/631*** | (2006.01) |

(52) U.S. Cl.

CPC ..... *H01R 13/523* (2013.01); *H01R 4/26* (2013.01); *H01R 4/56* (2013.01); *H01R 13/631* (2013.01); *H01R 43/26* (2013.01)

(58) Field of Classification Search

CPC ..... H01R 13/523; H01R 4/56; H01R 43/26; H01R 4/26

See application file for complete search history.

(56) References Cited

U.S. PATENT DOCUMENTS

| | | | | |
|---|---|---|---|---|
| 4,705,331 | A | 11/1987 | Britton | |
| 2014/0090846 | A1* | 4/2014 | Deutch | E21B 33/13 166/297 |
| 2016/0251940 | A1* | 9/2016 | De Witt | E21B 37/08 166/304 |
| 2019/0074630 | A1* | 3/2019 | Burrow | H01R 13/641 |
| 2019/0165559 | A1* | 5/2019 | Iversen | H02G 15/10 |

OTHER PUBLICATIONS

RetroClamp, Technical datasheet, 2014, 2 pages, Deepwater Corrosion Services Inc.

* cited by examiner

*Primary Examiner* — Jean F Duverne
(74) *Attorney, Agent, or Firm* — Jonathan Pierce; Pierre Campanac; Porter Hedges LLP

(57) ABSTRACT

An electro-mechanical connection is of the type of a "hot stab" connection. The connection also includes a jagged surface in the form of a scraper, which is capable of cutting through a deposit that could otherwise excessively increase the electrical resistance across the connection. The connection can be used underwater and installed by a diver or ROV, for example, for connecting cathodic protection to a subsea structure.

18 Claims, 3 Drawing Sheets

ELECTRICAL CONNECTION SYSTEM SUITABLE FOR PROVIDING CATHODIC PROTECTION UNDERWATER

CROSS-REFERENCE TO RELATED APPLICATIONS

This application claims the benefit of priority to U.S. provisional application Ser. No. 62/713,007 filed on Aug. 1, 2018, which is incorporated herein by reference.

BACKGROUND

This disclosure relates generally to connection systems that provide mechanical and electrical coupling. This disclosure relates more particularly to an electrical connection system that can be used underwater and installed by a diver or Remotely Operated Vehicle (ROV). Preferably, the electrical connection system comprises a scraper for improving the electrical coupling and is of a "hot stab" type.

Known connections suitable for use underwater, such as the RetroClamp, include a constant tension mechanical and electrical connection to metallic subsea tubulars. These known connections may be used to connect galvanic anodes, support monitoring instruments, or establish electrical continuity between two subsea metallic entities, one of which being a metallic subsea tubulars.

These known connections are sometimes not practical, for example, when none of the two subsea metallic entities that need to be connected is a tubular. Further, when a marine deposit has formed on the metallic subsea entities, the resistance of the electric coupling may remain excessive for providing an effective cathodic protection.

Thus, there is a continuing need in the art for connection systems that provide mechanical and electrical coupling. Preferably, the connection systems create an electrical pathway having a low resistance, even in the presence of a marine deposit.

BRIEF SUMMARY OF THE DISCLOSURE

The disclosure describes an electrical connection system that is preferably of the "hot stab" type.

The electrical connection system may comprise a first connector assembly. For example, the first connector assembly may include a first conductive body and a shaft. The shaft may be rotatable inside a bore of the first conductive body. In some embodiments, the first connector assembly may comprise a first threaded portion. The first threaded portion may be disposed around the rotatable shaft. The first conductive body may be capable of being connected to a cable.

The first conductive body may have a jagged surface. For example, the jagged surface may comprise at least one tooth. Preferably, the jagged surface may be formed by a plurality of teeth. Each of the plurality of teeth may include a wedge-shaped ridge. In some embodiments, the jagged surface may be disposed on a scraper. The scraper may be mounted in an aperture, which may be included in the first conductive body, such that the jagged surface may protrude from the aperture. Preferably, the scraper may be mounted in the aperture using a compliant element. The compliant element may include a spring pin.

The first connector assembly may also have a first guide surface. Directions of the first guide surface and an envelope of the jagged surface may be oblique. For example, the first guide surface may comprise at least a portion of a first cylindrical surface. The envelope of the jagged surface may comprise at least a portion of another cylindrical surface. The other cylindrical surface may be inclined relative to the first cylindrical surface, such as by a shallow angle.

The electrical connection system may comprise a second connector assembly. For example, the second connector assembly may include a second conductive body and a hole. In some embodiments, the second connector assembly may comprise a second threaded portion. The second threaded portion may be disposed inside the hole. The second conductive body may be capable of being connected to a subsea structure.

The second conductive housing may have a contact surface. The contact surface may be essentially smooth.

The second connector assembly may also have a second guide surface. Directions of the second guide surface and the contact surface may be parallel. For example, the second guide surface may comprise a portion of a second cylindrical surface. The contact surface may comprise another portion of the second cylindrical surface.

Upon connection of the first connector assembly with the second connector assembly, the first threaded portion may engage the second threaded portion. The first guide surface of the first connector assembly may engage and slide against the second guide surface of the second connector assembly. The jagged surface of the first conductive body may engage and scrape the contact surface of the second conductive body. Thus, an electrically conductive pathway may be created between the first connector assembly and the second connector assembly.

The disclosure also describes a method of using an electrical connection system that is preferably of the "hot stab" type.

The method may comprise connecting the cable to the first connector assembly. The method may comprise connecting the subsea structure to the second connector assembly.

The method may comprise connecting the first connector assembly with the second connector assembly. For example, the method may comprise engaging the first threaded portion with the second threaded portion and causing the first guide surface of the first connector assembly to engage and slide against the second guide surface of the second connector assembly. The method may further comprise causing the jagged surface of the first conductive body to engage and scrape the contact surface of the second conductive body, for example, to cut through a deposit on the second conductive body. The method may further comprise deflecting the compliant element.

The method may further comprise creating an electrically conductive pathway between the cable and the subsea structure. In some embodiments, the electrical pathway may be created in the absence of seals between the first connector assembly and the second connector assembly. In some embodiments, the method may further comprise maintaining a potential of the subsea structure via the cable for providing cathodic protection to the subsea structure.

BRIEF DESCRIPTION OF THE DRAWINGS

For a more detailed description of the embodiments of the disclosure, reference will now be made to the accompanying drawings, wherein.

DETAILED DESCRIPTION

The disclosure describes a robust electro-mechanical connection, which may be used underwater and installed by a diver or ROV. The electrical connection may be achieved even in the absence of seals. The type of connection is preferably that of a "hot stab." Also, the connection includes a jagged surface, for example, in the form of a scraper. Upon connection, the jagged surface may be capable of cutting through a marine deposit that may otherwise excessively increase the electrical resistance across the connection. The connection may be used for providing cathodic protection to a subsea structure, such as by maintaining a potential of the subsea structure (e.g., grounding the subsea structure) via a cable.

Figure 1:
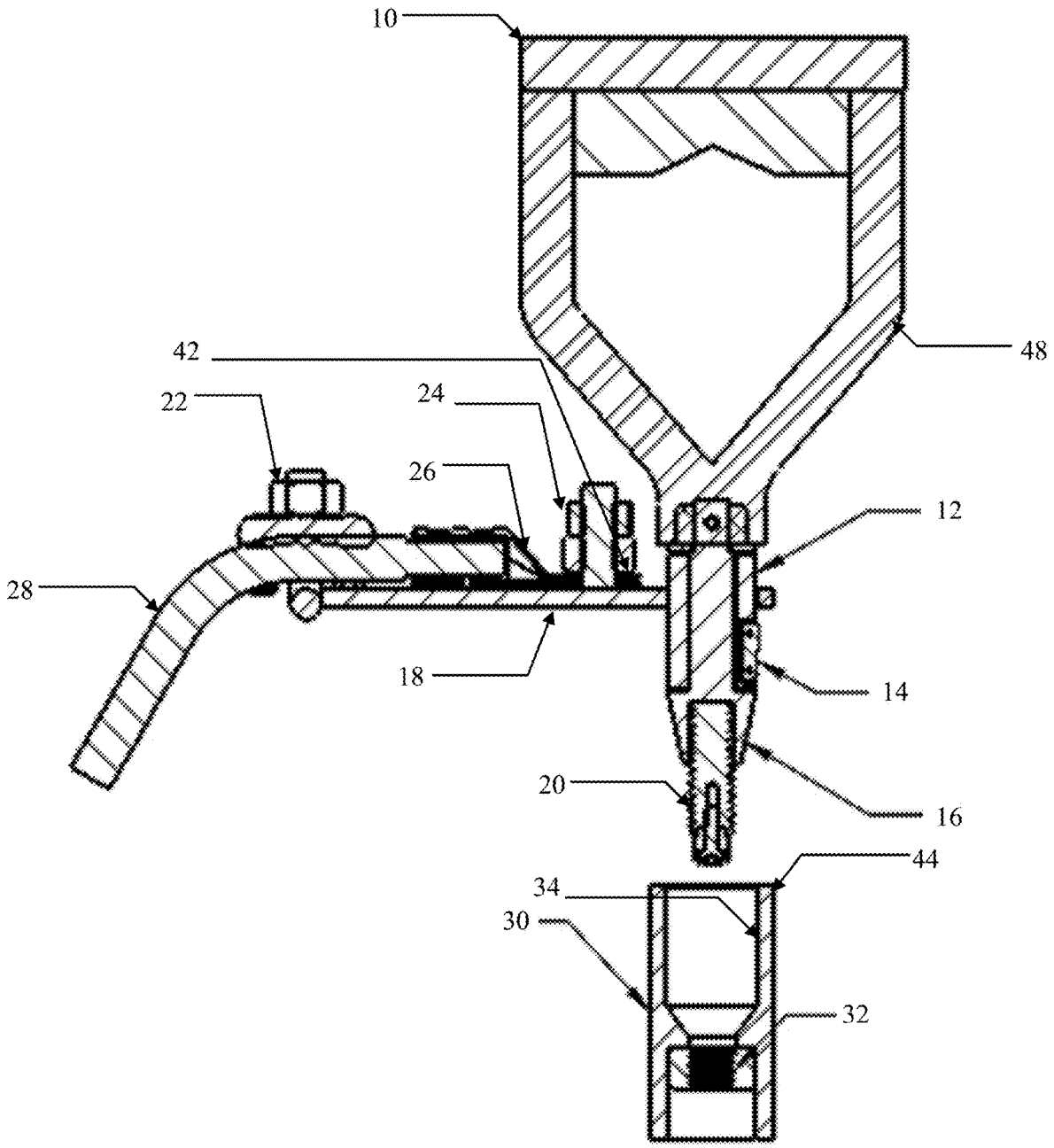
FIG. 1 is a sectional view of an electrical connection system in accordance with a first embodiment.

Referring to FIG. 1, an electrical connection system in accordance with a first embodiment is illustrated. The electrical connection system is designed for connecting a single-conductor, electrical cable 28, to a subsea structure (not shown). The electrical connection system is preferably designed for multiple connect/disconnect cycles when operated by a diver or ROV.

The electrical connection system comprises a female connector assembly 44 that may be welded, bolted, or otherwise affixed to the subsea structure, such as a manifold, wellhead, or other subsea production or exploration equipment. The female connector assembly 44 comprises an electrically conductive body forming a cylindrical receiver 30 and a female threaded component 32. The female threaded component 32 interfaces with a male threaded component 20 on a male stab connector assembly 10.

The male stab connector assembly 10 comprises an electrically conductive body 18, a portion of which forming a cylindrical housing 12, and a rotatable shaft 16. The cylindrical housing 12 incorporates a scraper 14 that engages a contact surface 34 of the cylindrical receiver 30 to create an extremely low resistance electrical pathway. The scraper 14 is preferably toothed. The contact surface is preferably smooth.

The rotatable shaft 16 passes through the cylindrical housing 12 to engage the cylindrical receiver 30. The male stab connector assembly 10, including the scraper 14, has tapered shapes that make the male stab connector assembly 10 self-aligning in the cylindrical receiver 30 to facilitate ROV operation. The male threaded component 20 engages the female threaded component 32 by rotation and thereby forces the cylindrical housing 12 and scraper 14 into the cylindrical receiver 30 and holds the cylindrical housing 12 and scraper 14 in place to secure the connection. Conversely, the rotatable shaft 16 may be used to push the cylindrical housing 12 and scraper 14 out of the cylindrical receiver 30 when disconnection of the cable 28 is desired.

In use, the male stab connector assembly 10 is fixed to the electrical cable 28 at the surface before deployment. For example, a cable termination 26 may be clamped on the electrically conductive body 18 with holding means 42, such as a washer, and tightening means 24, such as a nut and bolt assembly. The male stab connector assembly 10 may optionally be fitted with a strain relief 22 or similar device to protect the cable 28 from being pulled out of the cable termination 26.

In the embodiment shown in FIG. 1, the rotatable shaft 16 is fitted with an ROV handle 48 to allow the male stab connector assembly 10 to be installed with an ROV's manipulator. In other embodiments, the rotatable shaft 16 may alternatively be fitted with a nut or similar feature that allows the shaft to be turned with a torque wrench.

In the embodiment shown in FIG. 1, the scraper 14 is incorporated in the cylindrical housing 12 of the male stab connector assembly 10. In other embodiments, the scraper 14 may alternatively be incorporated in the cylindrical receiver 30 of the female connector assembly 44 and may engage a contact surface on the cylindrical housing 12 of the male stab connector assembly 10.

In the embodiment shown in FIG. 1, the female threaded component 32 is provided on the female connector assembly 44, and the male threaded component 20 is provided on the male stab connector assembly 10. In other embodiments, the female threaded component 32 may alternatively be provided on male stab connector assembly 10, and the male threaded component 20 may be provided on the female connector assembly 44.

In the embodiment shown in FIG. 1, the jagged surface of the scraper 14 is provided by at least one tooth, which is oriented perpendicularly to the direction of insertion of the male stab connector assembly 10 into the female connector assembly 44. In other embodiments, the jagged surface of the scraper 14 may alternatively be provided by a plurality of teeth, which may all be identical and may consist of a wedge-shaped ridge. In one embodiment, the height of the teeth is approximately 0.025 inch (+/−10%), and the teeth cut at an angle of approximately 60 degrees (+/−10 degrees). The jagged surface of the scraper 14 may be implemented using other shapes, such as a knurled pattern, a chevron pattern, or other pattern known to a person having ordinary skill in the art as being suitable for scraping the contact surface 34. Preferably, the scraper 14 is made of a material sufficiently hard to scrape the contact surface 34. For example, the ultimate strength of the material underlying the jagged surface of the scraper 14 may be at least 50% higher the ultimate strength of the material underlying the contact surface 34 of the cylindrical receiver 30.

Figure 2:
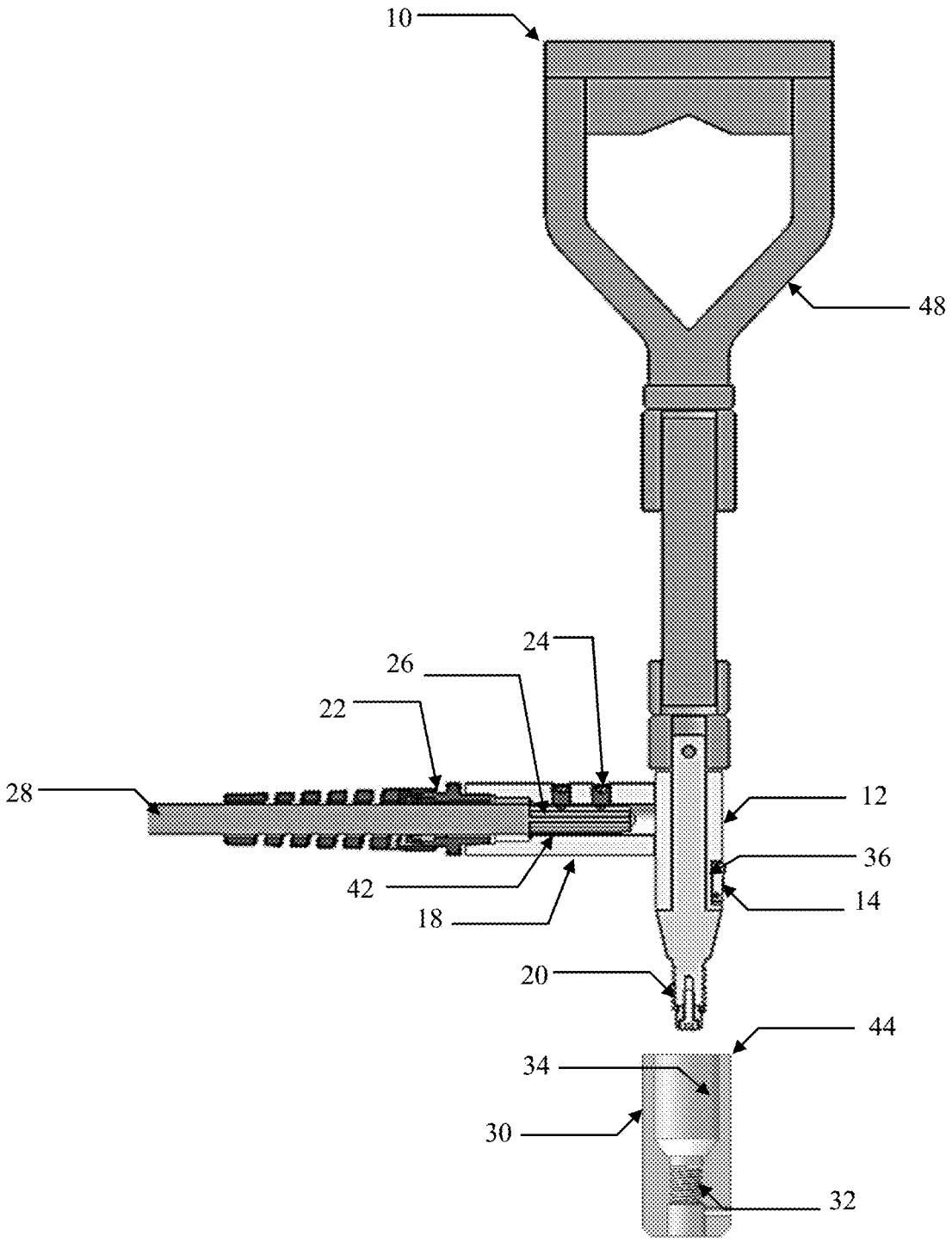
FIG. 2 is a sectional view of an electrical connection system in accordance with a second embodiment.

Turning to FIG. 2, a second embodiment of an electrical connection system is illustrated. The electrical connection system comprises a first connector assembly 10 and a second connector assembly 44 that are of the "hot stab" type.

The first connector assembly 10 includes a first conductive body 18. The first conductive body 18 is configured to be connected to a cable 28. For example, the first conductive body 18 may be provided with means 42 for holding a cable termination 26, such as a grounding sleeve made of copper, and tightening means 24, such as screws. Also, the cable may be provided with a strain relief 22. The first conductive body 18 has a jagged surface. The jagged surface is disposed on a scraper 14. The scraper 14 may be mounted in an aperture 36, which may be provided in the first conductive body 18, such that the jagged surface protrudes from the aperture 36. The first conductive body 18 may comprise a cylindrical housing 12.

The first connector assembly 10 further comprises a shaft 16. The shaft 16 is rotatable inside a bore of the first conductive body 18, such as a bore in the cylindrical housing 12. A compliant ROV handle 48 is connected to shaft 16 to facilitate rotation by a typical ROV manipulator.

The first connector assembly 10 further comprises a first threaded portion 20. The first threaded portion 20 may be disposed around the rotatable shaft 16.

The first connector assembly 10 further comprises a first guide surface. For example, the first guide surface may comprise at least a portion of a first cylindrical surface, such as an outer surface of the cylindrical housing 12.

The second connector assembly 44 may essentially consist of a second conductive body. The second conductive body may be configured to be connected to subsea structure such as by welding, bolting, clamping, strapping, or another way of attaching the second conductive body to the subsea structure. The second conductive housing may have a contact surface 34. The contact surface 34 may be essentially smooth. The second conductive body may essentially consist of a cylindrical receiver 30.

The second connector assembly 44 further comprises a hole, such as provided by a portion of an inner surface of the cylindrical receiver 30.

The second connector assembly 44 further comprises a second threaded portion 32. The second threaded portion 32 may be disposed inside the hole.

The second connector assembly 44 further comprises a second guide surface, such as provided by another portion of the inner surface of the cylindrical receiver 30. Thus, directions of the second guide surface and the contact surface 34 may be parallel.

Figure 3:
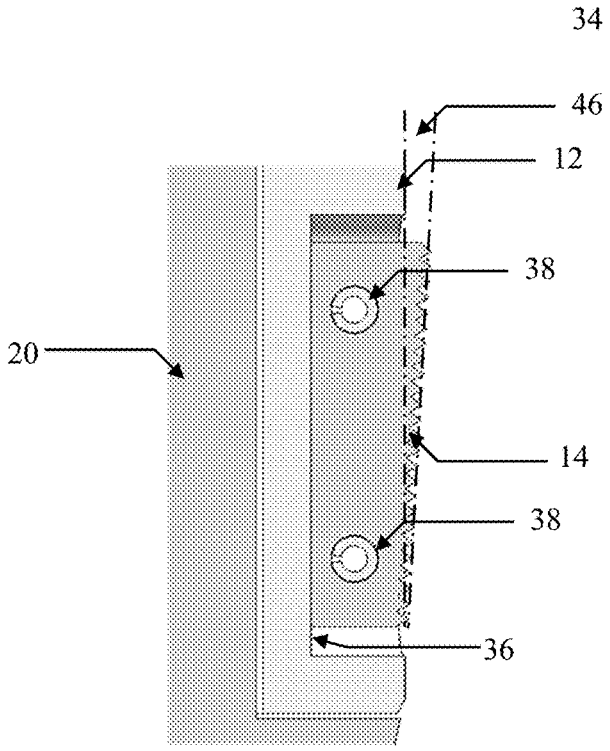
FIG. 3 is a sectional view of the scraper of the electrical connection system shown in FIG. 1 or 2.

Turning to FIG. 3, the scraper 14 may be mounted in the aperture 36 using a compliant element. The compliant element may include at least one spring pin 38.

The jagged surface disposed on the scraper 14 is formed by a plurality of teeth. Each of the plurality of teeth may preferably include a wedge-shaped ridge.

An envelope of the jagged surface provided on the scraper 14 may be cylindrical. The envelope may be inclined relative to the outer surface of the cylindrical housing 12, such as by a shallow angle 46. Thus, the scraper 14 has a taper and is easily engaged with the contact surface 34.

In the embodiment shown in FIG. 3, the jagged surface disposed on the scraper 14 is formed by a plurality of teeth. In other embodiments, the jagged surface may comprise only one tooth.

In the embodiment shown in FIG. 3, both the envelope of the jagged surface provided on the scraper 14 and the first guide surface formed by a portion of the outer surface of the cylindrical housing 12 are cylindrical. In other embodiments, the envelope of the jagged surface and/or the first guide surface may have a different shape, while directions of these surfaces may remain oblique so that the scraper 14 is easily engaged with the contact surface 34.

Figure 4:
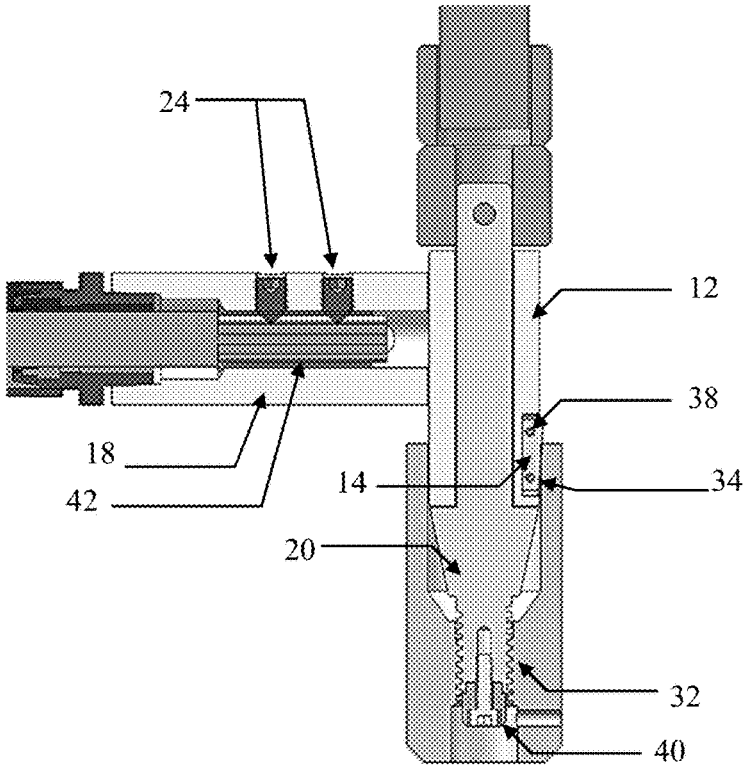
FIG. 4 is a sectional view of a portion of the electrical connection system shown in FIG. 2, illustrated after connection.

Turning to FIG. 4, upon connection of the first connector assembly 10 with the second connector assembly 44, the first threaded portion 20 engages the second threaded portion 32. The first guide surface of the first connector assembly 10 engages and slides against the second guide surface of the second connector assembly 44. The jagged surface of the scraper 14 engages and scrapes the contact surface 34 and may cut through a marine deposit that may have formed on the contact surface 34. The spring pins 38 can deflect inward. Thus, an electrically conductive pathway is created between the first connector assembly 10 and the second connector assembly 44.

Optionally, a stab nose 40, which may be made of plastic, may be attached (e.g., screwed) to the end of the first connector assembly 10. The stab nose 40 may further assist in aligning the first connector assembly 10 with the second connector assembly 44 and further facilitate ROV operations.

In some embodiments, the electrical pathway may be created in the absence of seals between the first connector assembly and the second connector assembly.

Specific embodiments of the invention are shown by way of example in the drawings and description. It should be understood, however, that the drawings and detailed description thereto are not intended to limit the claims to the particular form disclosed, but on the contrary, the intention is to cover all modifications, equivalents, and alternatives falling within the scope of the claims.

What is claimed is:

1. A connection system, comprising:

a first connector assembly, the first connector assembly including a first conductive body capable of being connected to a cable, the first conductive body having a jagged surface, the first connector assembly comprising a first threaded portion; and a second connector assembly, the second connector assembly including a second conductive body capable of being connected to subsea equipment, the second conductive body having a contact surface, the second connector assembly comprising a second threaded portion;

wherein, upon connection of the first connector assembly with the second connector assembly, the first threaded portion engages the second threaded portion and the jagged surface of the first conductive body engages and scrapes the contact surface of the second conductive body, whereby an electrically conductive pathway is created between the first conductive body of the first connector assembly and the second conductive body of the second connector assembly.

2. The connection system of claim 1, the first connector assembly having a first guide surface; and the second connector assembly further having a second guide surface, wherein, upon connection of the first connector assembly with the second connector assembly, the first guide surface engages and slides against the second guide surface.

3. The connection system of claim 2, wherein directions of the first guide surface and an envelope of the jagged surface are oblique, and wherein directions of the second guide surface and the contact surface are parallel.

4. The connection system of claim 3, wherein the first guide surface comprises at least a portion of a first cylindrical surface;

wherein the envelope of the jagged surface comprises a portion of a cylindrical surface, which is inclined relative to the first cylindrical surface;

wherein the second guide surface comprises a portion of a second cylindrical surface; and wherein the contact surface comprises another portion of the second cylindrical surface.

5. The connection system of claim 1 wherein the first conductive body includes an aperture and a scraper mounted in the aperture, wherein the jagged surface is disposed on the scraper, and wherein the jagged surface protrudes from the aperture.

6. The connection system of claim 5 wherein the scraper is mounted in the aperture using a compliant element.

7. The connection system of claim 6 wherein the compliant element includes a spring pin.

8. The connection system of claim 1 wherein the jagged surface comprises at least one tooth.

9. The connection system of claim 8 wherein the contact surface is essentially smooth.

10. The connection system of claim 8 wherein the jagged surface is formed by a plurality of teeth.

11. The connection system of claim 10 wherein each of the plurality of teeth includes a wedge-shaped ridge.

12. The connection system of claim 1 wherein the first connector assembly comprises a shaft rotatable inside a bore of the first conductive body, wherein the first threaded portion is disposed around the rotatable shaft, wherein the second connector assembly comprises a hole, and wherein the second threaded portion is disposed inside the hole.

13. A method of using a connection system, comprising:

connecting a cable to a first connector assembly, the first connector assembly including a first conductive body configured to be connected to the cable, the first conductive body having a jagged surface, the first connector assembly including a first threaded portion; and connecting subsea equipment to a second connector assembly, the second connector assembly including a second conductive body configured to be connected to the subsea equipment, the second conductive housing having a contact surface, the second connector assembly including a second threaded portion;

connecting the first connector assembly with the second connector assembly;

engaging the first threaded portion with the second threaded portion;

causing the jagged surface of the first conductive body to engage and scrape the contact surface of the second conductive body upon connection of the first connector assembly with the second connector assembly; and creating an electrically conductive pathway between the cable and the subsea equipment.

14. The method of claim 13, further comprising cutting through a deposit on the contact surface with the jagged surface.

15. The method of claim 13, further comprising causing a first guide surface of the first connector assembly to engage and slide against a second guide surface of the second connector assembly upon the connection of the first connector assembly with the second connector assembly.

16. The method of claim 13, further comprising deflecting a compliant element, wherein the first conductive body includes an aperture and a scraper mounted in the aperture, wherein the jagged surface is disposed on the scraper, wherein the jagged surface protrudes from the aperture, wherein the scraper is mounted in the aperture using the compliant element.

17. The method of claim 13, further comprising maintaining a potential of the subsea equipment via the cable for providing cathodic protection to the subsea equipment.

18. The method of claim 13, wherein the electrically conductive pathway between the cable and the subsea equipment is created in absence of seals between the first connector assembly and the second connector assembly.

* * * * *